US006384695B2

(12) United States Patent
Kpodzo et al.

(10) Patent No.: US 6,384,695 B2
(45) **Date of Patent: *May 7, 2002**

(54) HIGH POWER COMBINER APPARATUS

(75) Inventors: Elias Bonaventure Kpodzo, Franklin Park; Greg Alan Nease, East Windsor, both of NJ (US)

(73) Assignee: Lucent Technologies Inc., Murray Hill, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/264,051

(22) Filed: Mar. 8, 1999

(51) Int. Cl.[7] ..... H01P 1/32; H01P 1/36; H01P 5/12

(52) U.S. Cl. ..... 333/124; 333/1.1; 333/24.2

(58) Field of Search ..... 333/1.1, 109, 124, 333/24.2, 117, 24.1

(56) References Cited

U.S. PATENT DOCUMENTS

| | | | | | |
|---|---|---|---|---|---|
| 3,743,972 | A | * | 7/1973 | Miura et al. | 333/1.1 |
| 4,315,222 | A | | 2/1982 | Saleh | 330/124 |
| 4,449,128 | A | * | 5/1984 | Weir | 343/858 |
| 4,539,681 | A | | 9/1985 | Hudspeth et al. | 370/119 |
| 4,697,160 | A | | 9/1987 | Clark | 333/103 |
| 4,804,931 | A | | 2/1989 | Hulick | 332/31 |
| 5,032,799 | A | | 7/1991 | Milberber et al. | 330/311 |
| 5,083,094 | A | | 1/1992 | Forsberg | 330/124 |
| 5,222,246 | A | | 6/1993 | Wolkstein | 455/13.4 |
| 5,382,925 | A | * | 1/1995 | Hayashi et al. | 333/112 |
| 5,610,556 | A | | 3/1997 | Rubin | 330/124 |
| 5,745,525 | A | | 4/1998 | Hunsinger et al. | 375/285 |
| 5,812,221 | A | * | 9/1998 | Davis et al. | 348/723 |
| 5,854,986 | A | * | 12/1998 | Dorren et al. | 455/562 |
| 5,939,939 | A | * | 8/1999 | Gaynor et al. | 330/124 R |

FOREIGN PATENT DOCUMENTS

| | | | |
|---|---|---|---|
| FR | 2556887 | 12/1983 | H01P/1/38 |
| JP | 55058601 | 1/1980 | H01P/5/12 |
| JP | 61123201 | 11/1986 | H01P/5/12 |

OTHER PUBLICATIONS

C–E. W. Sundberg, et al., "Technology Advances Enabling "In–Band On–Channel" DSB Systems", Broadcast Asia 98 International Conference, Singapore, Jun. 1–4, 1998, pp. 289–294.

S. Pai, "In–Band On–Channel: The Choice Of US Broadcasters," Broadcast Asia 98 International Conference, Singapore, Jun. 1–4, 1998, pp. 283–287.

(List continued on next page.)

*Primary Examiner*—Robert Pascal
*Assistant Examiner*—Kimberly E Glenn
(74) *Attorney, Agent, or Firm*—Donald P. Dinella

(57) ABSTRACT

A high power combiner arrangement with improved isolation between input ports for high power applications. In particular, in accordance with high power combiner arrangement, power combining logic is combined with a series of isolators such that at least one isolator is inserted between each power source, i.e., a signal source, and a corresponding input port to the power combining logic. The number of isolators inserted is determined as a function of the isolation requirements of the overall application. Advantageously, the degree of isolation achieved by the high power combiner is directly proportional to the number of inserted isolators placed between each power source. Furthermore, the insertion of a number of high power circulators between each power source and the power combing logic facilitates the achievement of higher isolation between the power sources with minimal degradation in signal characteristics.

33 Claims, 2 Drawing Sheets

OTHER PUBLICATIONS

C–E. W. Sundberg, "Digital Audio Broadcasting An Overview Of Some Recent Activities In The US", IEEE NORSIG–97, Tromso, Norway, May 23–24, 1997, pp. 1–5.

C–E. W. Sundberg, "Digital Audio Broadcasting In The FM Band", Proceedings of the IEEE International Symposium on Industrial Electronics, vol. 1, Guimaraes, Portugal, Jul. 7–11, 1997, pp. SS37–SS41.

B. W. Kroeger, et al., "Improved IBOC DAB Technology For AM And FM Broadcasting", SBE Engineering Conference, 1996, pp. 1–10.

Alfred Huthig, "Microwave Technology, Waveguides and Line Components", vol. I, Heidelberg, 1984, Forward and pp. 230–235.

* cited by examiner

HIGH POWER COMBINER APPARATUS

FIELD OF THE INVENTION

The present invention relates to power combiner networks and, more particularly, to the selection of multiple power levels using power combiners.

BACKGROUND OF THE INVENTION

Power combiners are well-known devices that couple electromagnetic energy from multiple input ports to an output port in a prescribed manner. As is well-known, high power combiners are used in a number of application such as (i) combining two or more signals at the same or different frequencies for transmission by a common antenna; (ii) combining an analog signal and a digital signal for common antenna transmission, e.g., digital television and/or digital audio broadcast applications; and (iii) combining outputs of multiple power amplifiers.

The art is replete with power combiner arrangements for use, inter alia, in the above-described applications. For example, U.S. Pat. No. 4,315,222 issued to A. Saleh on Feb. 8, 1982, which is hereby incorporated by reference for all purposes, describes a power combiner arrangement for microwave power amplifiers which employs a series of sensing devices at the inputs to the combiner for identifying failed amplifiers at the inputs thereby improving the degradation performance of the microwave power amplifier. U.S. Pat. No. 4,697,160 issued to R. T. Clark on Sep. 29, 1987, which is hereby incorporated by reference for all purposes, describes a hybrid power combiner and controller for achieving power combination with improved finer amplitude control having reduced insertion loss. Further, U.S. Pat. No. 5,222,246 issued to H. J. Wolkstein on Jun. 22, 1993, which is hereby incorporated by reference for all purposes, describes a power amplifier arrangement employing a phase-sensitive power combiner for dividing a input signal into equal amplitude components for amplification purposes. As will be appreciated, the performance specifications of such power combiners continue to become more varied and stringent with the advent of new and/or expanded applications.

For example, in the United States AM/FM radio broadcast market, digital audio broadcast ("DAB") technology, e.g., so-called In-Band On-Channel ("IBOC"), is under consideration for widespread application. Digital audio broadcast applications are described, e.g., in Carl-Erik Sundberg, "Digital Audio Broadcasting in the FM Band", *Proceedings of the IEEE Symposium on Industrial Electronics,* Portugal, Jun. 1–11, 1997, and Carl-Erik Sundberg, "Digital Audio Broadcasting: An Overview of Some Recent Activities in the U.S.", *Proceedings of Norsig*-97, Norwegian Signal Processing Symposium, Tromso, Norway, May 23–24, 1997, each of which are hereby are incorporated by reference for all purposes. Further, IBOC is described, e.g., in Carl-Erik Sundberg et al., "Technology Advances Enabling In-Band-On-Channel DSB Systems", *Proceedings of Broadcast Asia,* June 1998, Suren Pai, "In-Band-On-Channel: The Choice of U.S. Broadcasters", *Proceedings of Broadcast Asia,* June 1998, and B. W. Kroeger et al., "Improved IBOC DAB Technology for AM and FM Broadcasting", *SBE Engineering Conference,* pp. 1–10, 1996, each of which are hereby are incorporated by reference for all purposes. IBOC broadcasting systems utilize a digital overlay in the current FM analog broadcast band to deliver digital audio content. In accordance with IBOC, lower power digital signals, e.g., 20 to 30 dB below the analog signal level, are embedded as two sidebands on either side of the analog signal transmission within ±200 kHz (off center frequency) as is required by current FCC regulations. As such, the digital sidebands are immediately adjacent to the analog band with virtually no significant separation between the frequencies of the analog and digital signals. Therefore, in order to achieve a degree of compatibility between the analog and digital signals, a sufficient isolation between the analog signal transmitter and digital signal transmitter must be achieved. In particular, a higher isolation is required from the analog transmitter to digital transmitter than from the digital transmitter to the analog transmitter because of the relatively large differential (e.g., 20 to 25 dB) in power levels between the two signals.

The challenge of achieving higher isolation, e.g., 60 to 80 dB, in an application such as IBOC, i.e., isolation between power sources where at least one source is much higher than the other, is to provide the requisite isolation with minimal degradation in insertion loss and group delay variation. As will be appreciated, depending upon the specific application the term "high power" will have different meanings. For example, in cellular applications, high power typically means 100 W or greater. Further, as will be appreciated, frequency proximity requirements also vary by application and impact such high power applications. More particularly, problems arise in high power combining when high isolation is required for signals having overlapping or nearly overlapping spectral occupancy characteristics. In cases where the signals are spectrally proximate but not overlapping, prior art high power combiners typically employ filtering in combination with power combining to increase isolation. However, the need for severe filter transitions, in the most proximal cases, often leads to undesirable distortions of the signals as they undergo the combining process. Furthermore, those signals to be combined that have overlapping spectral occupancies cannot benefit from these filtering schemes to increase isolation, but must rely solely upon inherent isolation of the core combiner.

Therefore, a need exists for a high power combiner with improved isolation between input ports for high power applications with minimal degradation in signal characteristics, e.g., insertion loss and/or group delay variation.

SUMMARY OF THE INVENTION

The present invention is directed to a high power combiner arrangement with improved isolation between input ports for high power applications. In particular, in accordance with the preferred embodiment of the invention, power combining logic is combined with a series of isolators such that at least one isolator is inserted between at least one power source, i.e., a signal source, and a corresponding input port to the power combining logic. The number and location of isolators inserted is determined as a function of the isolation requirements of the overall application. In accordance with the preferred embodiment, at least one isolator is a three port junction circulator device formed by a symmetrical junction transmission line coupled to a magnetically-biased ferrite material. Further, in accordance with preferred embodiments of the invention, the at least one circulator has at least one port terminated with a resistive matched load such that when one of the three ports of the circulator is terminated with the matched load, the circulator becomes an isolator which will isolate the incident and reflected signals at the remaining two ports.

Advantageously, in accordance with the invention, the degree of isolation achieved by the high power combiner is directly proportional to the number of isolators placed between each power source. Furthermore, the insertion of a number of high power circulators between each power source and the power combing logic facilitates the achievement of higher isolation between the power sources with limited degradation in signal characteristics.

In accordance with a further embodiment of the invention, the power combining logic is a hybrid coupler combined with a series of circulators such that at least one circulator is inserted between a power source and a corresponding input port to the hybrid coupler. As above, the number of circulators inserted is determined as a function of the isolation requirements of the overall application.

BRIEF DESCRIPTION OF THE DRAWINGS

Throughout this disclosure, unless otherwise noted, like elements, blocks, components or sections in the figures are denoted by the same reference designations.

DETAILED DESCRIPTION

The present invention is directed to a high power combiner arrangement with improved isolation between input ports for high power applications. In particular, in accordance with the preferred embodiment of the invention, power combining logic is combined with a series of isolators such that at least one isolator is inserted between at least one power source, i.e., a signal source, and a corresponding input port to the power combining logic. The number of isolators inserted is determined as a function of the isolation requirements of the overall application. In accordance with the preferred embodiment, at least one isolator is a three port junction circulator device formed by a symmetrical junction transmission line coupled to a magnetically-biased ferrite material. Advantageously, in accordance with the invention, the degree of isolation achieved by the high power combiner is directly proportional to the number of inserted isolators placed between a power source and the corresponding input port. Furthermore, the insertion of a number of high power circulators between the power sources and the power combing logic facilitates the achievement of higher isolation between the power sources with minimal degradation in signal characteristics.

It should be noted that for clarity of explanation, the illustrative embodiments described herein are presented as comprising individual functional blocks or combinations of functional blocks. The functions these blocks represent may be provided through the use of either shared or dedicated hardware, including, but not limited to, hardware capable of executing software. Illustrative embodiments may comprise digital signal processor ("DSP") hardware and/or software performing the operations discussed below. Further, in the claims hereof any element expressed as a means for performing a specified function is intended to encompass any way of performing that function, including, for example, a) a combination of circuit elements which performs that function; or b) software in any form (including, therefore, firmware, object code, microcode or the like) combined with appropriate circuitry for executing that software to perform the function. The invention defined by such claims resides in the fact that the functionalities provided by the various recited means are combined and brought together in the manner which the claims call for. Applicants thus regard any means which can provide those functionalities as equivalent as those shown herein.

Figure 1:
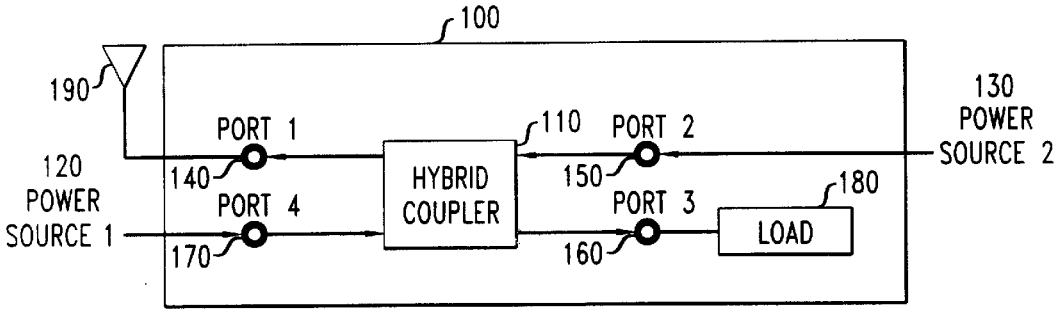
FIG. 1 (PRIOR ART)
FIG. 1 shows an illustrative prior art power combiner.

In order to provide context and facilitate an understanding of the invention, a brief overview of an illustrative prior art power combiner will now be discussed. More particularly, FIG. 1 shows illustrative prior art power combiner 100 as a well-known multiport device which couples electromagnetic energy from the incident to the output ports in a prescribed manner. In particular, hybrid coupler 110 is a device having four ports, ports 140–170, respectively. The ports of hybrid coupler 110 are configured as follows: power source 120, i.e. a first signal source, is connected to port 170, power source 130, i.e., a second signal source, is connected to port 150, antenna 190 is connected to port 140, and balancing load 180 is connected to port 160. As will be appreciated, part of the signal from power source 120 at port 170 leaks, in a well-known manner, to port 150 and port 160, respectively, and part of the signal from power source 130 at port 150 leaks to port 160 and port 170, respectively. Further, leakages at port 160 are dissipated in balancing load 180.

As will be understood, one goal in any power combining arrangement, such as power combiner 100, is that signal leakages to any port except the main output port, e.g., port 140 of hybrid coupler 110, be minimized to prevent interference between the sources. As such, the level of leakage between port 150 and port 170 is defined as the isolation between these two ports, respectively. For conventional commercially available hybrid coupler arrangements, e.g., hybrid coupler 110, this isolation value is typically in the range of 15 to 35 dB. Combining multiple power sources requires these signals to be coupled with appropriate phase and amplitude relationships which, as is well-known, are achieved in hybrid coupler 110 by requiring good matches at all ports under all signal conditions. Nevertheless, the isolation from one power source to another power source achieved by power combiner 100 is a direct relation to that which is provided as a function of hybrid coupler 110, i.e., an isolation of 20 to 35 dB.

Traditionally, to apply power combiner 100 in high power combining applications (e.g., in a IBOC DAB application high power ranges from 100 W to 100 kW), the use of filter networks, e.g., bandpass, bandstop, low pass and/or high pass filters, have been used to achieve additional isolation between multiple power sources, e.g., power source 120 and 130, respectively. Such filter networks are inserted, illustratively, in power combiner 100 at either port 170 or port 150 after power source 120 or power source 130, respectively, in a well-known manner. However, such conventional configurations of power combiners suffer from certain drawbacks such as incurring undue insertion losses and/or group delay variations when the signals to be combined are close in frequency.

In contrast, we have recognized a high power combiner arrangement with significantly improved isolation between input ports for high power applications. In particular, in accordance with the preferred embodiment of the invention, power combining logic is combined with a series of isolators such that at least one isolator is inserted between a power source and a corresponding input port to the power combining logic. The number of isolators inserted is determined as a function of the isolation requirements of the particular application. In accordance with the preferred embodiment, at least one isolator is a three port junction circulator device formed by a symmetrical junction transmission line coupled to a magnetically-biased ferrite material. Advantageously, in accordance with the invention, the degree of isolation achieved by the high power combiner is directly proportional to the number of inserted isolators placed between the power source and the corresponding input port. Furthermore, the insertion of a number of high power isolators between the power source and the power combing logic facilitates the achievement of higher isolation between the power sources with minimal degradation in signal characteristics.

Figure 2:
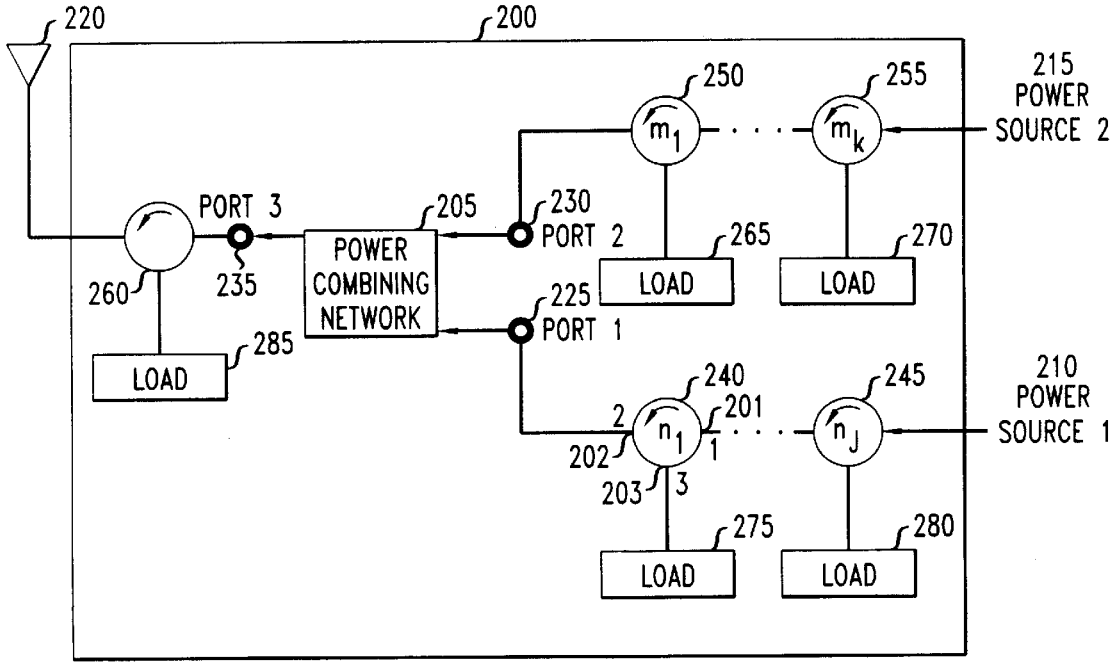
FIG. 2 shows an illustrative power combiner configured in accordance with the preferred embodiment of the invention.

More particularly, FIG. 2 shows illustrative power combiner 200 configured in accordance with the preferred embodiment of the invention. Power combiner 200 includes power combining network 205, and ports 225–235, respectively, which provide connections, inter alia, to first power source 210, second power source 215, and antenna 220. As such, power combiner 200 is used to effectively combine the two signals from power sources 210 and 215, respectively, for output through port 235 to antenna 220. For example, using power combiner 200 the two signals from power sources 210 and 215 may be signals at the same or different frequencies which are transmitted by the same antenna, i.e., antenna 220. Further, illustratively, using power combiner 200 the two signals from power sources 210 and 215 may be of different signal types. For example, the signals from the power sources may be any combination of analog signals and digital signals which are to be transmitted over a common antenna, i.e., antenna 220, such as in a digital television or digital audio broadcast applications.

For example, in a IBOC application there is little or no separation between frequencies of the analog and digital signals of such applications. Thus, to transmit both the analog and digital signals over the same antenna in an IBOC system, with minimal signal degradation, isolation between these signals must suppress interactions between source signals to ensure that the combined signal will satisfy and comply with the predetermined requirements as specified in the so-called FCC mask. As will be appreciated, such isolation requirements are primarily a function of the class of transmitter station deployed in the digital audio broadcast system. Advantageously, in accordance with the invention, the degree of isolation achieved by the high power combiner is directly proportional to the number of inserted isolators placed between each power source. Furthermore, the insertion of a number of high power circulators between each power source and the power combing logic facilitates the achievement of higher isolation between the power sources with limited degradation in signal characteristics.

More particularly, in accordance with the invention, isolators are employed in the power combiner arrangement to improve the impedance matches at ports 225–235. In particular, FIG. 2 illustratively shows a series of isolators $N_1$ through $N_j$, see, e.g., isolator 240 through isolator 245, respectively, displaced between power source 210 and port 225 of power combining network 205. As will be appreciated, power combining network 205, in accordance with various embodiments of the invention, can be a hybrid coupler, a so-called Wilkinson divider/combiner, or similar combiner circuitry consisting of lumped or distributed components (e.g., resistors, capacitors, inductors, and the like), taken either individually, or in any combination, with a filter network at the particular input ports of the power combing network 205. Further, power combiner 200 further illustratively shows a series of isolators $M_1$ through $M_k$, see, e.g., isolator 250 through isolator 255, respectively, displaced between power source 215 and port 230. In accordance with the preferred embodiment of the invention, isolators 240–260 are shown as well-known circulator devices in power combiner 200. As will be appreciated, circulators are typically used for directing signals to a particular load using its signal duplexing device characteristics. Further, isolators are used for the isolation of incident and reflected signals in electronic devices. As such, we have recognized that such circulator devices can be used effectively in accordance with the principles of the invention to deliver a power combiner with significantly enhanced isolation between input ports in high power applications with minimal degradation of signal characteristics as further discussed below.

In addition, in accordance with the preferred embodiment, isolator 260 is inserted between antenna 220 and the final output, i.e., port 235, of power combining network 205 to ensure that power combiner 200 is matched with a sufficient impedance value despite being subject to potentially poor antenna impedances resulting, in a well-known fashion, from conditions such as temperature, frequency and aging. That is, the use of isolator 260 between port 235 of power combining network 205 and antenna 220 provides a robust interface to antenna 220 and minimizes RF power reflected from antenna 220 from being dissipated in power combiner 200 and/or power sources 210 and 215, respectively. In addition, by providing robust termination impedance the optimal isolation performance of combiner 200 is optimized.

More particularly, isolators 240–260, are each a three port junction circulator device formed by a symmetrical "Y" junction transmission line coupled to a magnetically-biased ferrite material. As will be appreciated, the combination of the ferrite material, magnetic bias and transmission line realization determines the actual power handling capability of the circulator. That is, when one of the three ports of the circulator (see, e.g., circulator 240 having ports 201, 202, and 203, respectively) is terminated with a matched load, the circulator becomes an isolator which will isolate the incident and reflected signals at the remaining two ports. For example, with respect to circulator 240, a signal incident at port 201 is directed to port 202 of circulator 240. If there is a matched load, e.g., matched load 280, a large percentage of the power proportional to the so-called return loss of the load at port 202 is dissipated in matched load 280 at port 202. When the load at port 202 is very well matched, e.g., with a return loss of −20 dB or better, only a particular ratio of the power incident at port 202 will be reflected or directed to port 203 and dissipated in the matched load at port 203.

Thus, in accordance with the preferred embodiment of the invention, power combiner 200 includes matched loads 265–285, with each respective load being matched to a particular isolator. A typical matched load is a one port device with a purely resistive 50 Ohm impedance capable of absorbing incident electromagnetic energy and converting such energy to heat for dissipation. For example, isolator 240 is matched with matched load 275, and isolator 250 is matched with matched load 265. In accordance with the invention, the number of isolators, e.g., circulators, placed between a particular power source and corresponding input port is a function of the isolation requirements of the application itself. Furthermore, the typical isolation realized per circulator, as in the configuration of FIG. 2., is approximately 20 dB with an incurred insertion loss of less than 1 dB. That is, the higher the isolation requirements of the application there is an expected increase in insertion loss. Thus, in accordance with the preferred embodiment of the invention, the selection of the number of isolators in terms of the isolation requirements also involves a trade-off between insertion loss due to each isolator and the total isolation value required.

Figure 3:
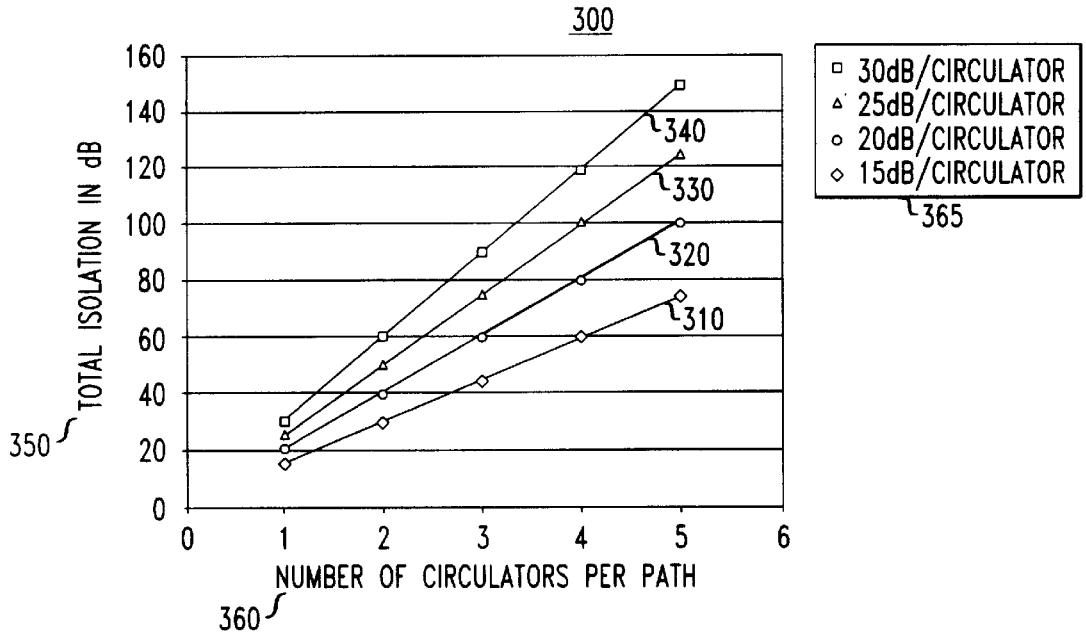
FIG. 3 shows illustrative graphical results of total isolation results achieved using the power combiner arrangement of the invention as shown in FIG. 2.

To further illustrate this aspect of the invention, FIG. 3 shows illustrative graphical results 300 of the total isolation that is achievable against the number of circulators disbursed in the power combiner arrangement of the present invention. In particular, total isolation (in dB) 350 is plotted versus number of circulators per path 360 for a variety of dB/circulator ratios (see, ratio legend 365) as shown in straight line plots 310 through 340, respectively. As is immediately evident from illustrative graphical results 300, the power combiner arrangement of the present invention achieves significantly higher isolation between power sources than conventional high power combiners.

Figure 4:
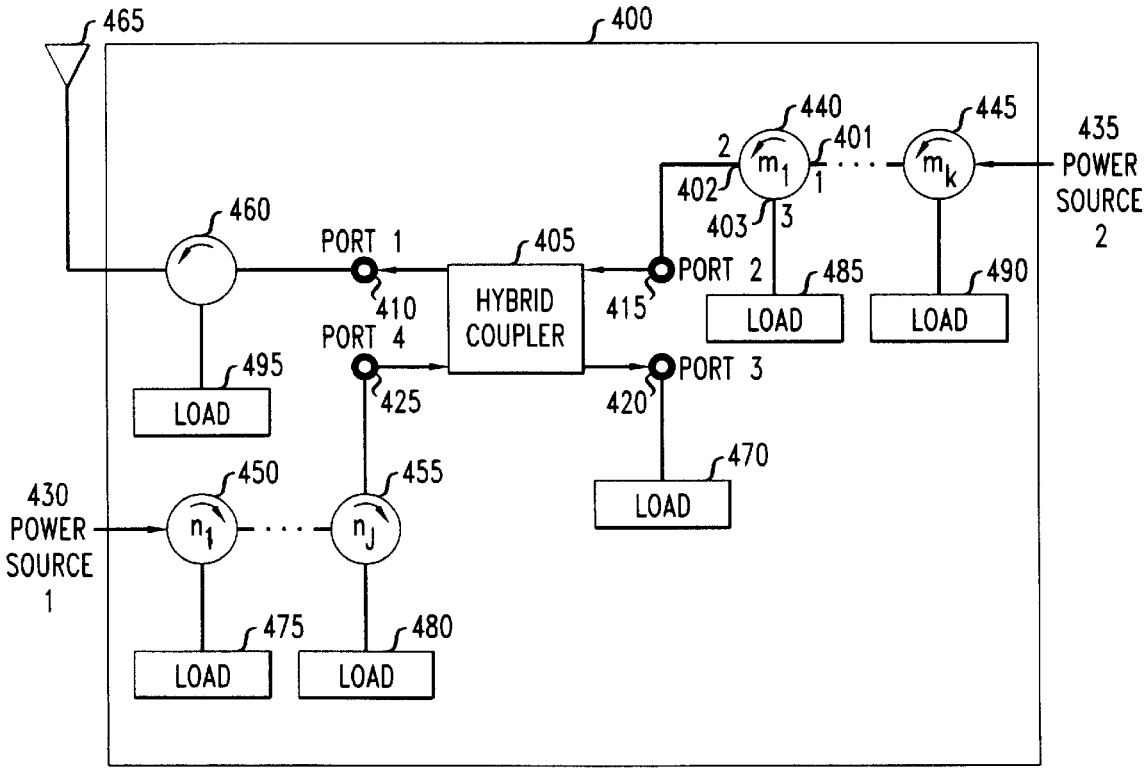
FIG. 4 shows an illustrative hybrid power combiner configured in accordance with a further embodiment of the invention.

FIG. 4 shows illustrative power combiner 400 configured in accordance with a further embodiment of the invention. More particularly, power combiner 400 includes hybrid coupler 405 having four input ports, ports 410–425, respectively. Hybrid couplers, as discussed previously, are well-known devices that couple electromagnetic energy from an input source to multiple output ports in a prescribed manner. Thus, hybrid coupler 405 is used effectively with power source 430 and power source 435 to transfer electromagnetic energy using combiner 400. That is, hybrid coupler 405 is used to effectively combine the two signals from power sources 430 and 435, respectively, for output through port 410 to antenna 465. However, we have realized that the performance of hybrid coupler 405 in a high power application can be significantly improved by using a series of circulators in conjunction with the coupler.

More particularly, in accordance with this embodiment of the invention, circulators are employed to improve the impedance matches at the input ports 410–425. In particular, FIG. 4 illustratively shows a series of circulators $N_1$ to $N_j$, see, e.g., circulator 450 through circulator 455, respectively, displaced between power source 430 and port 425 of hybrid coupler 405. In accordance with the illustrative embodiment of FIG. 4, circulators 440–460, are each a three port junction circulator device formed by a symmetrical "Y" junction transmission line coupled to a magnetically-biased ferrite material. As described above, when one of the three ports of the circulator (see, e.g., circulator 440 having ports 401, 402, and 403, respectively) is terminated with a matched load, the circulator becomes an isolator which will isolate the incident and reflected signals at the remaining two ports. Further, as discussed above, the combination of the ferrite material, magnetic bias and transmission line realization determines the actual power handling capability of the circulator. That is, when one of the three ports of the circulator is terminated with a matched load, the circulator becomes an isolator which will isolate the incident and reflected signals at the remaining two ports. Thus, in accordance with this further embodiment of the invention, power combiner 400 includes matched loads 475–495, with each respective load being matched to a particular circulator. For example, circulator 450 is matched with matched load 475, and circulator 445 is matched with matched load 490.

As above, the present embodiment also includes circulator 460 inserted between antenna 465 and port 410 of hybrid coupler 405 to ensure that power combiner 400 is matched with a sufficient impedance value. That is, the use of circulator 460 between the final output, i.e., port 410, of hybrid coupler 405 and antenna 465 provides a robust interface to antenna 465 and minimizes RF power reflected from antenna 465 from being dissipated in power combiner 400 and/or power sources 430 and 435, respectively. Further, leakages at port 420 are dissipated, in a well-known manner, in balancing load 470.

As discussed above in the various embodiments, the present invention is directed to a high power combiner arrangement with improved isolation between input ports for high power applications. As such, our high power combiner is used effectively in any number of high power applications such as (i) combining two or more signals at the same or different frequencies for transmission by a common antenna; (ii) combining, in a variety of manners, analog signals and/or digital signals for common antenna transmission, e.g., digital television and/or digital audio broadcast applications; and (iii) combining outputs of multiple power amplifiers, to name just a few.

The foregoing merely illustrates the principles of the present invention. Therefore, the invention in its broader aspects is not limited to the specific details shown and described herein. Those skilled in the art will be able to devise numerous arrangements which, although not explicitly shown or described herein, embody those principles and are within their spirit and scope.

We claim:

1. An apparatus for combining at least two signals, the apparatus comprising:

a signal combining network for combining a first signal produced by a first signal source, and a second signal produced by a second signal source to form a combined signal, the first signal being an analog signal, the second signal being a digital signal and the first signal and the second signal having substantially similar frequency occupancy and the signal combining network having a plurality of ports, a first port of the plurality of ports receiving the first signal from the first signal source, and a second port of the plurality of ports receiving the second signal from the second signal source; and a plurality of isolators, at least one isolator located between the first port receiving the first signal and the first signal source.

2. The apparatus of claim 1 further comprising:

a connection between a third port of the plurality ports and a antenna for receiving and transmitting the combined signal from the signal combining network.

3. The apparatus of claim 2 wherein the frequency of the first signal matches the frequency of the second signal.

4. The apparatus of claim 2 wherein at least one isolator is placed between the antenna and the third port.

5. The apparatus of claim 1 wherein at least one isolator is a three port junction circulator.

6. The apparatus of claim 5 further comprising:

a plurality of loads, each load of the plurality of loads being matched with a particular one isolator of the plurality of isolators.

7. The apparatus of claim 6 wherein the circulator comprises a symmetrical "Y" junction transmission line coupled to a magnetically-biased ferrite material.

8. The apparatus of claim 2 wherein at least one isolator located between the second port receiving the second signal and the second signal source.

9. A power combiner for combining at least two signals, the power combiner comprising:

a power combining network for combining a first signal produced by a first power source, and a second signal produced by a second power source to form a combined signal, the first signal having analog signal characteristics, the second signal having digital signal characteristics and the first signal and the second signal having substantially overlapping frequency occupancy and the power combining network having a plurality of ports, a first port of the plurality of ports receiving the first signal from the first power source, and a second port of the plurality of ports receiving the second signal from the second power source; and a plurality of isolators, at least one isolator located between the first port receiving the first signal and the first power source, and at least one isolator located between the second port receiving the second signal and the second power source.

10. The power combiner of claim 9 wherein a degree of signal isolation for the power combiner is determined as a function of the plurality of isolators located between the power combining network and the first power source and the second power source.

11. The power combiner of claim 10 wherein the degree of signal isolation is greater than 15 dB.

12. The power combiner of claim 10 further comprising:

a antenna for receiving and transmitting a combined signal from the power combining network, the combined signal being a function of at least a portion of the first signal and at least a portion of the second signal.

13. The power combiner of claim 12 wherein the antenna is connected to a third port of the plurality of ports for receiving the combined signal from the power combining network.

14. The power combiner of claim 10 wherein at least one isolator is a three port junction circulator having a symmetrical "Y" junction transmission line coupled to a magnetically-biased ferrite material.

15. The power combiner of claim 10 further comprising:

a plurality of loads, each load of the plurality of loads being matched with a particular one isolator of the plurality of isolators.

16. The power combiner of claim 15 wherein the combined signal is transmitted from the antenna through a digital audio broadcast network.

17. The power combiner of claim 16 wherein the digital audio broadcast network employs IBOC signaling.

18. A hybrid power combiner for combining a plurality of signals produced by a plurality of power sources, each power source producing a respective one signal of the plurality of signals, the hybrid power combiner comprising:

a hybrid coupler having a plurality of ports, each port of the plurality of ports receiving a respective different one signal of the plurality of signals;

a signal combiner for combining at least a portion of a first signal of the plurality of signals with at least a portion of a second signal of the plurality of signals produced by a second power source thereby forming a combined signal, the first signal being an analog signal, the second signal being a digital signal, and the first signal and the second signal having a same frequency; and a plurality of circulators, at least one circulator connected between at least one port of the plurality of ports and the respective power source producing the signal received at the port, and at least another one circulator located between at least one other port of the plurality of ports and the respective power source producing the signal received at the other port.

19. The hybrid power combiner of claim 18 further comprising:

a antenna for receiving and transmitting a combined signal from the power combining network, the combined signal being a function of at least a portion of the first signal and at least a portion of the second signal.

20. The hybrid power combiner of claim 19 wherein the hybrid power combiner is part of a digital television apparatus.

21. The hybrid power combiner of claim 19 wherein a degree of signal isolation for the hybrid power combiner is determined as a function of the plurality of circulators.

22. The hybrid power combiner of claim 21 wherein the degree of signal isolation is greater than 15 dB.

23. The hybrid power combiner of claim 18 wherein at least one circulator is a three port junction circulator having a symmetrical "Y" junction transmission line coupled to a magnetically-biased ferrite material.

24. A digital audio broadcast system comprising:

a first power source producing a first signal, and a second power source producing a second signal;

a power combining network for combining the first signal and the second signal into a combined signal, the first signal being an analog signal, the second signal being a digital signal, and the first signal and the second signal being of a same frequency, the power combining network having a plurality of ports, a first port of the plurality of ports receiving the first signal from the first power source, and a second port of the plurality of ports receiving the second signal from the second power source;

a plurality of isolators, at least one isolator located between the first port receiving the first signal and the first power source, and at least one isolator located between the second port receiving the second signal and the second power source; and a antenna for transmitting the combined signal.

25. The digital audio broadcast system of claim 24 wherein a degree of signal isolation for the hybrid power combiner is determined as a function of the plurality of isolators.

26. The digital audio broadcast system of claim 25 wherein the degree of signal isolation is greater than 15 dB.

27. The digital audio broadcast system of claim 26 wherein the antenna is connected to a third port of the plurality of ports and employs IBOC signaling in the transmitting of the combined signal.

28. The digital audio broadcast system of claim 26 wherein at least one isolator is a three port junction circulator having a symmetrical "Y" junction transmission line coupled to a magnetically-biased ferrite material.

29. The digital audio broadcast system of claim 28 further comprising:

a plurality of loads, each load of the plurality of loads being matched with a particular one isolator of the plurality of isolators.

30. An apparatus for combining at least two signals, the apparatus comprising:

means for combining a first signal produced by a first signal source with a second signal produced by a second signal source to form a combined signal, the first signal being an analog signal, the second signal being a digital signal, and the first signal and the second signal having a overlapping frequency occupancy, the signal combining means having a plurality of ports, a first port of the plurality of ports receiving the first signal from the first signal source, and a second port of the plurality of ports receiving the second signal from the second signal source; and means for isolating the first signal from the second signal, the isolating means employing at least one isolator displaced between the first port receiving the first signal and the first signal source.

31. The apparatus of claim 30 further comprising means for receiving and transmitting the combined signal from the signal combining means.

32. The apparatus of claim 30 wherein the at least one isolator is a three port junction circulator.

33. The apparatus of claim 32 wherein the means for receiving and transmitting is an antenna, the antenna having a connection to a third port of the plurality of ports.

* * * * *